US005857290A

United States Patent [19]

Schnarr

[11] Patent Number: 5,857,290

[45] Date of Patent: Jan. 12, 1999

[54] CHECKING DEVICE FOR ROLLER SUPPORTED DOORS

[75] Inventor: Raymond H. Schnarr, Princeton, Ill.

[73] Assignee: Schlage Lock Company, San Francisco, Calif.

[21] Appl. No.: 995,238

[22] Filed: Dec. 19, 1997

[51] Int. Cl.[6] ..... E05F 15/00

[52] U.S. Cl. ..... 49/138; 49/15; 49/425; 16/91; 16/102

[58] Field of Search ..... 49/15, 138, 409, 49/410, 423, 414, 425, 360; 16/91, 102

[56] References Cited

U.S. PATENT DOCUMENTS

| | | | |
|---|---|---|---|
| 1,606,049 | 11/1926 | Youngblood . | |
| 2,423,129 | 7/1947 | Tobias | 188/33 |
| 2,526,503 | 10/1950 | Raque | 49/138 |
| 3,378,952 | 4/1968 | Bidelmay et al. | 49/138 X |
| 3,406,484 | 10/1968 | Atkey et al. | 49/138 X |
| 3,431,678 | 3/1969 | Stuart, et al. | 49/360 |
| 4,067,144 | 1/1978 | Ogishi | 49/360 |
| 4,912,878 | 4/1990 | Bently | 49/379 |
| 5,165,142 | 11/1992 | Pilsbury | 16/91 X |

*Primary Examiner*—Jerry Redman
*Attorney, Agent, or Firm*—Michael H. Minns

[57] ABSTRACT

A check mechanism is provided to regulate door speed of a roller supported sliding door as the door is manually opened or closed. The check mechanism includes an idler arm assembly attached to a door hanger with an idler roller attached to the idler arm assembly. The check mechanism further includes a pivotable spring biased lever arm having two inclined ramp sections. As the door slides, the idler roller contacts the lever arm. The inclination of the ramp causes an increasing retardation force to be applied to the idler roller, thereby retarding the speed of the door. After the idler roller passes a point of maximum retarding force, the door becomes free wheeling until a second idler roller contacts the lever arm of a second checking mechanism which in turn slows the speed of the door.

15 Claims, 5 Drawing Sheets

CHECKING DEVICE FOR ROLLER SUPPORTED DOORS

BACKGROUND OF THE INVENTION

This invention relates generally to checking the movement of prison doors and more particularly to a means for controlling the speed of roller supported sliding prison doors.

In many prisons, heavy roller supported sliding doors are used to close prison cells. Sometimes, prisoners will slam the doors open or closed which can damage latches, locks, wheel bearings, limit switches and other door hardware.

The foregoing illustrates limitations known to exist in present prison doors. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a means for regulating the speed of a slidable door, the means comprising: an idler arm attached to a door hanger; an idler roller rotatably attached to the idler arm; and a control means for applying a retarding force on the idler roller.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

An object of the invention is to provide a means to regulate the speed of sliding prison cell doors as they are opened and closed. The cell doors typically weigh about 300 pounds and are freewheeling. In some installations, the cell doors are opened and closed remotely. In other installations, the cell doors are opened and closed manually.

Figure 1:
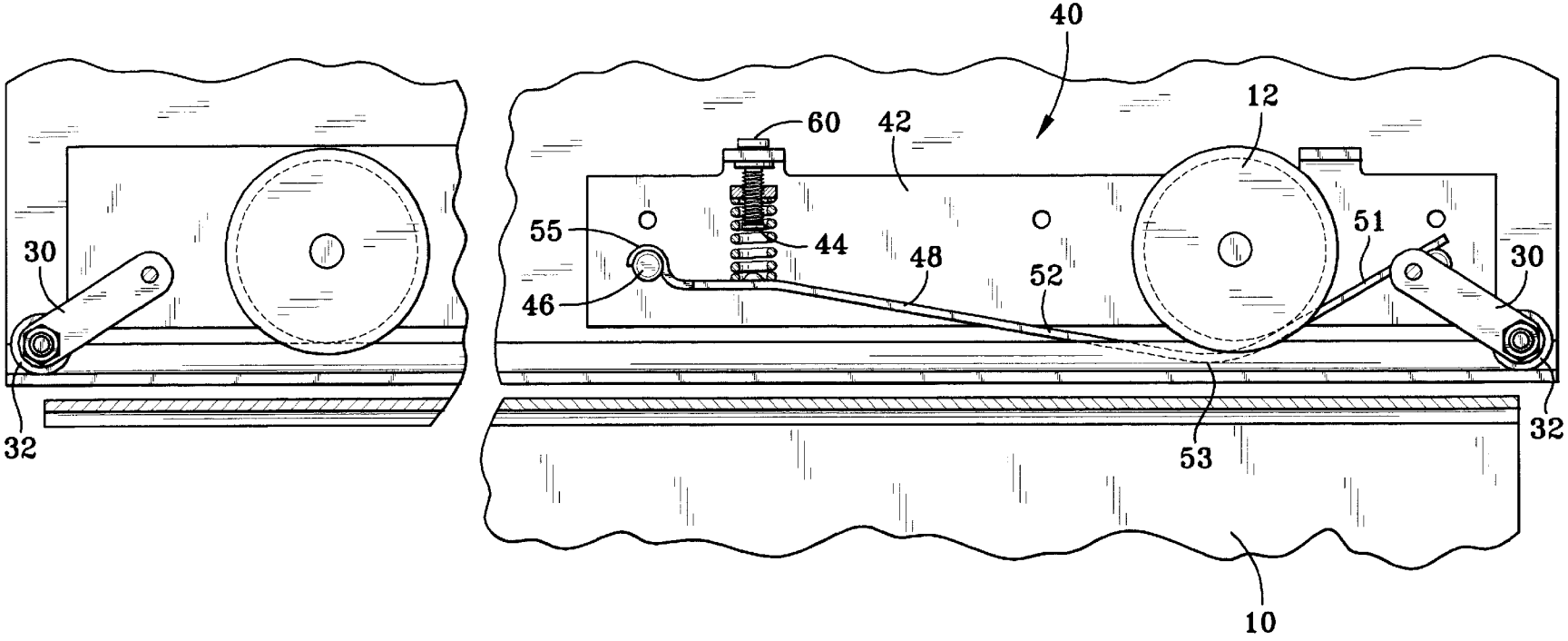
FIG. 1 is a front view of a roller supported door with the speed checking device of the present invention attached at a first end of the door with the door in a first position, portions of the door support mechanism have been omitted to more clearly show the speed checking device.
Figure 1A:
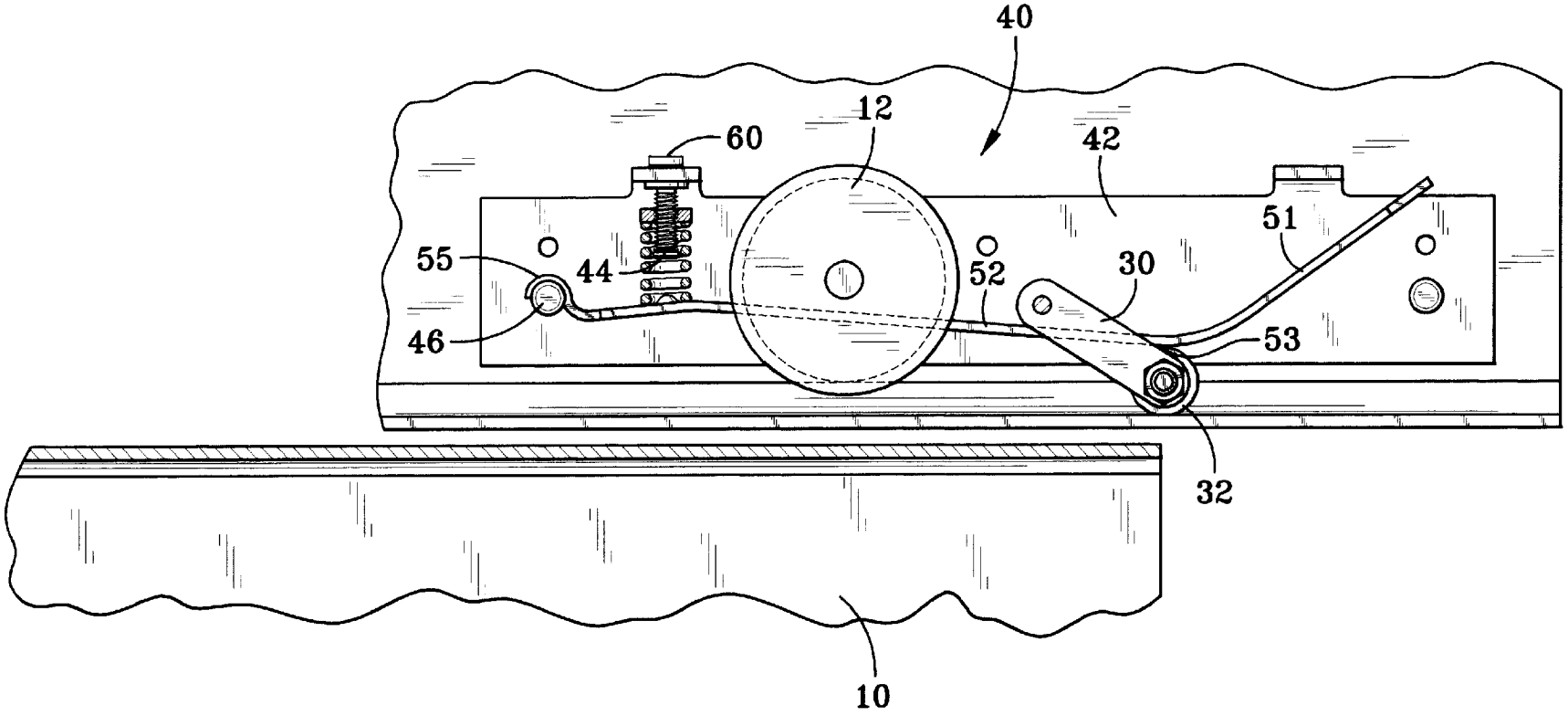
FIG. 1A is front view of the roller supported door shown in FIG. 1 with the door in a second position.
Figure 2:
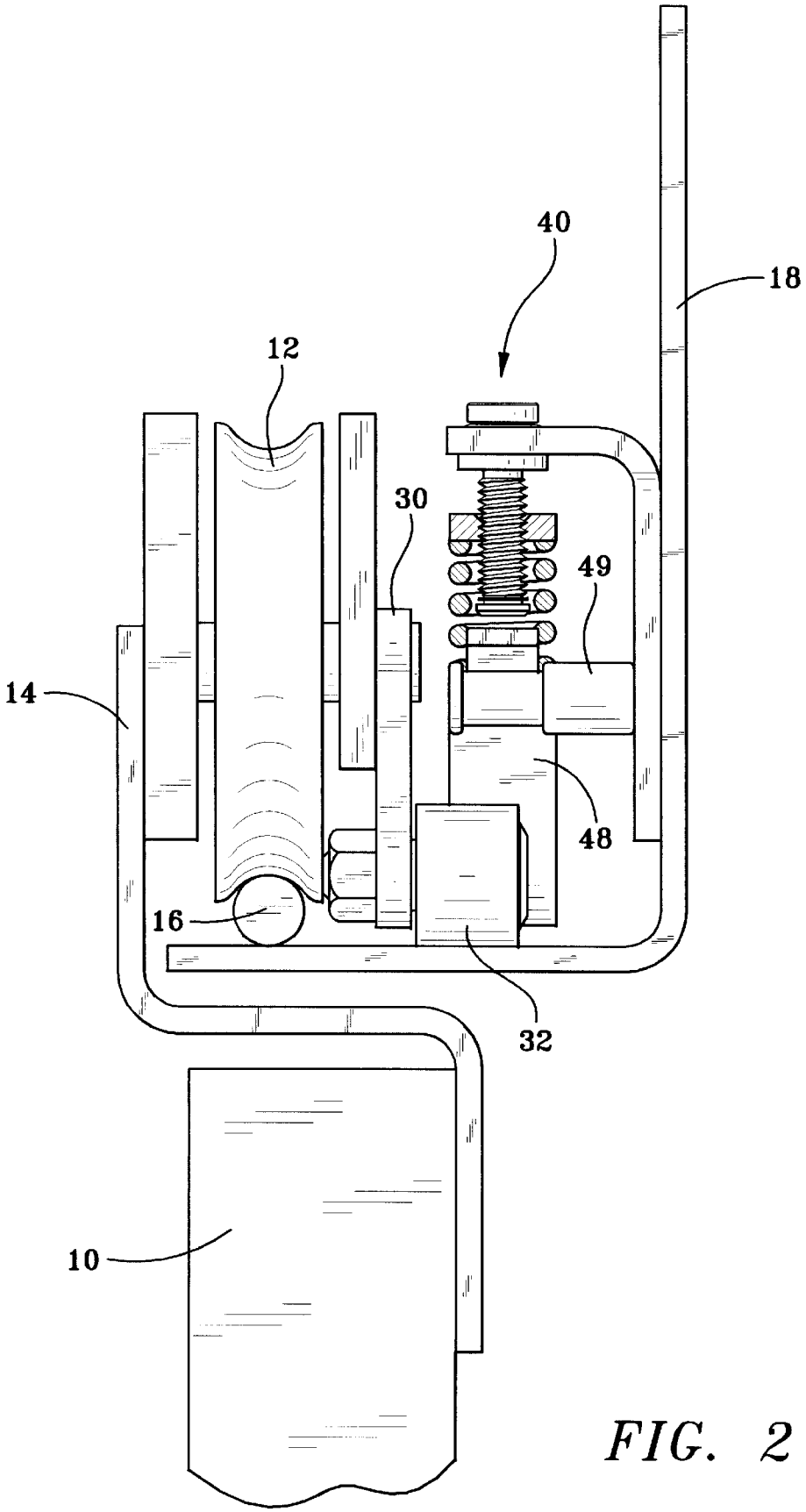
FIG. 2 is an end view of the speed checking device shown in FIG. 1.
Figure 3:
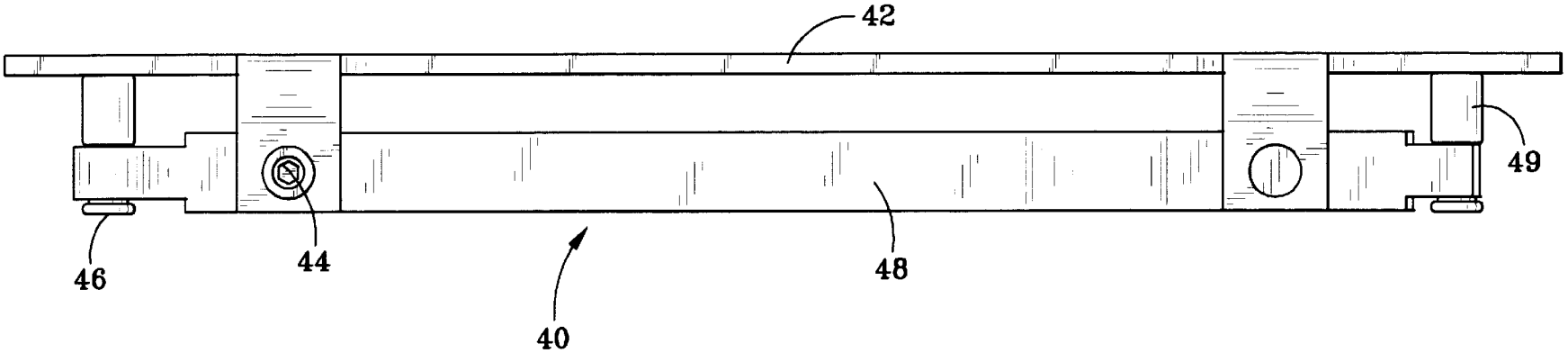
FIG. 3 is a top view of the speed checking device shown in FIG. 1.

FIGS. 1 and 1A show a checking device or speed regulator 40, which is designed to control the cell door 10. Preferably, checking device 40 is installed at both ends of the door opening. The checking device 40 is designed to control the speed of the door 10 by applying regulated restraints or retarding force at the opening and/or closing of the door 10. The retarding force is applied approximately 10 inches from completely closed and approximately 10 inches from completely open. The distance can be more or less per the user's discretion when installing the checking device 40.

Also, there is approximately 3 inches of free movement from completely open and/or closed to allow a spring loaded plunger (not shown) to move the door 10 out of reach of a drop bar latch (not shown) when the door 10 is electrically unlocked.

The cell door 10 is attached to a plurality of door hangers 14. Attached to door hangers 14 are a corresponding plurality of steel rollers 12 which roll on track 16 which is attached to door support 18. The checking device 40 includes an idler arm assembly 30 attached to door hanger 14. An idler roller 32 is attached to the idler arm assembly 30. Because the idler arm assembly 30 and idler roller 32 are attached to a door hanger 14, the idler arm assembly 30 and idler roller 32 move with the door 10 and door hanger 14. The checking device 40 further includes a spring biased lever arm 48, which is biased towards the idler roller 32. As the door 10 is opened, the idler arm 30 and idler roller 32 move to the left (in FIG. 1) until the idler roller 32 contacts the lever arm 48. The lever arm 48 includes a first ramp section 51 and a second ramp section 52 which are inclined relative to one another and are inclined relative to guide track 16. As the door continues to move to the left, the idler roller 32 moves along the first ramp section 51 and the inclination of the first ramp section 51 causes the retarding force applied to idler roller 32 to increase as the door 10 continues to move to the left until the retarding force reaches a maximum at point 53. The retarding force applied by lever arm 48 causes a braking action on the idler roller 32 and therefore on door 10. A spring 44 with an adjustment screw 60 is provided to bias the lever arm 48 into towards idler roller 32 and to allow adjustment of the force applied by lever arm 48.

One end of lever arm 48 has a hook portion 55 thereon which hooks about a pivot stud 46 (about which the lever arm 48 pivots) attached to a backing plate 42. The other end of lever 48 rests upon a lever arm support stud 49 also attached to the backing plate 42.

Figure 4:
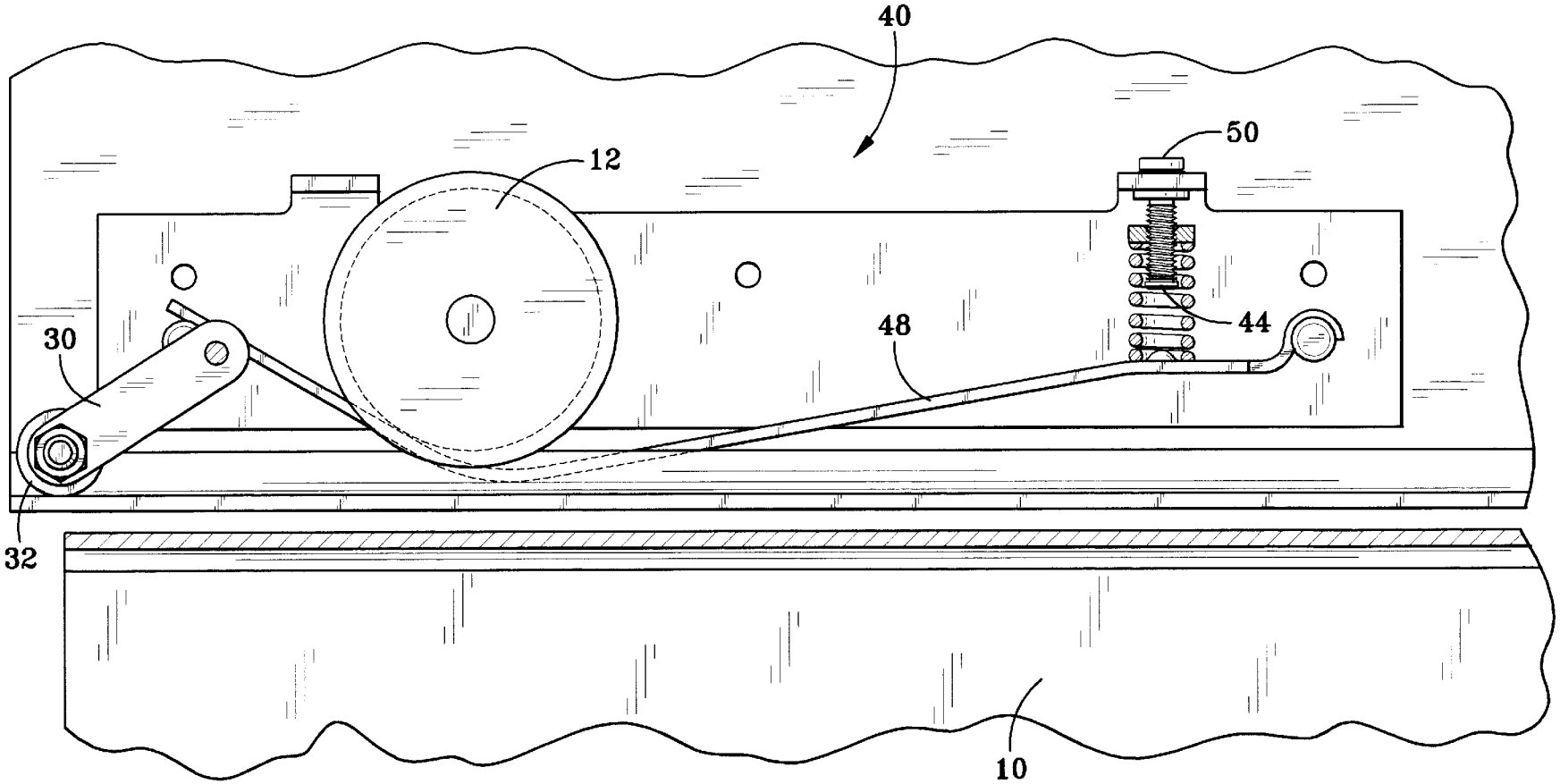
FIG. 4 is a front view of a roller supported door having a second speed checking device at the other end of the door opening.

After the idler roller 32 passes the point of maximum force 53, the door 10 becomes free wheeling until a second idler roller 32, which is attached to a second idler arm assembly 30, which in turn is connected to a second door hanger 14 at the other end of the door opening, comes in contact with lever arm 48 of a second checking device 40 (as shown in FIG. 4). Once the idler 32 contacts lever arm 48, the spring bias of the lever arm 48 along with the inclination of second ramp section 52, results in an increasing retarding force being applied to idler roller 32 thereby slowing the speed of the door 10 until the idler roller 32 passes the point of maximum force 53.

Having described the invention, what is claimed is:

1. In combination, a slidable door having at least one roller attached to a door hanger and a checking means attached to a door support for regulating speed of the door, the checking means comprising:

an idler arm attached to the door hanger;

an idler roller rotatably attached to the idler arm; and a control means comprising a pivotably mounted lever arm engaging the idler roller and for applying a retarding force on the idler roller.

2. The combination according to claim 1, wherein the control means further comprises a spring biasing the lever arm towards the idler roller.

3. The combination according to claim 2, wherein the spring includes a means for adjusting the spring force.

4. The combination according to claim 1, wherein the lever arm has a first ramp section and a second ramp section the first ramp section being inclined at an angle to the second ramp section.

5. The combination according to claim 4, wherein the point where the first ramp section is proximate the second ramp section is a point at which the control means applies a maximum retarding force on the idler roller.

6. The combination according to claim 1, wherein the control means further comprises a lever arm stop, an end of the lever arm distal from the lever arm axis of pivot resting on the lever arm stop.

7. The combination according to claim 1, wherein the axis of pivot of the lever arm is at an end of the lever arm.

8. The combination according to claim 7, wherein the pivot end of the lever arm has a semi-circular hook thereon, the hook engaging a pivot stud.

9. In combination, a slidable door having at least one roller attached to a door hanger and a checking means for regulating speed of the door, the checking means comprising:

an idler roller operably attached to the door hanger; and a control means applying a retarding force on the idler roller, the control means comprising: a pivotably mounted lever arm engaging the roller; and a spring biasing the lever arm towards the idler roller.

10. The combination according to claim 9, wherein the lever arm has a first ramp section and a second ramp section, the first ramp section being inclined at an angle to the second ramp section.

11. In combination, a slidable door having a plurality of rollers, each roller being attached to a door hanger, the rollers rolling on a guide track attached to a door support and;

a least one checking means for regulating speed of the door, the checking means comprising: a rotatable idler roller operably attached to a door hanger; and a control means for applying a retarding force on the idler roller, the control means comprising: a pivotably mounted lever arm engaging the idler roller during a portion of the travel of the door, the lever arm having first and second ramp sections joined to one another, the first and second ramp sections being inclined at an angle to one another, the point at which the first and second ramp sections are joined to one another being the point at which the control means applies a maximum retarding force on the idler roller; and an adjustable spring biasing the lever arm towards the idler roller.

12. The combination according to claim 11, wherein the number of control means is two.

13. The combination according to claim 11, wherein the control means further comprises a lever arm stop, an end of the lever arm distal from the lever arm axis of pivot resting on the lever arm stop.

14. The combination according to claim 11, wherein the axis of pivot of the lever arm is at an end of the lever arm.

15. In combination, a slidable door having at least one roller attached to a door hanger; and a checking means for regulating speed of the door, the checking means comprising:

a rotatable idler roller operably attached to the door hanger; and a control means for applying a retarding force on the idler roller, the control means comprising: a pivotably mounted lever arm for engaging the roller, the lever arm axis of pivot being at an end thereof, the lever arm having first and second ramp sections joined to one another, the first and second ramp sections being inclined at an angle to one another, the point at which the first and second ramp sections are joined to one another being the point at which the control means applies a maximum retarding force on the idler roller; a lever arm stop, an end of the lever arm distance from the lever arm axis of pivot resting on the lever arm stop; and an adjustable spring bearing the lever arm towards the idler roller.

* * * * *